US008494846B2

(12) United States Patent
Dai et al.

(10) Patent No.: US 8,494,846 B2
(45) Date of Patent: Jul. 23, 2013

(54) METHOD FOR GENERATING BACKGROUND NOISE AND NOISE PROCESSING APPARATUS

(75) Inventors: Jinliang Dai, Shenzhen (CN); Libin Zhang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 406 days.

(21) Appl. No.: 12/886,159

(22) Filed: Sep. 20, 2010

(65) Prior Publication Data

US 2011/0010167 A1 Jan. 13, 2011

Related U.S. Application Data

(63) Continuation of application No. PCT/CN2009/070840, filed on Mar. 17, 2009.

(30) Foreign Application Priority Data

Mar. 20, 2008 (CN) ..... 2008 1 0085177

(51) Int. Cl.
*G10L 21/02* (2006.01)
*G10L 19/00* (2006.01)

(52) U.S. Cl.
USPC ..... 704/226; 704/201; 704/200.1

(58) Field of Classification Search
USPC ..... 704/201–230, E19.001–E21.02
See application file for complete search history.

(56) References Cited

U.S. PATENT DOCUMENTS

| | | | | |
|---|---|---|---|---|
| 6,324,505 | B1 * | 11/2001 | Choy et al. | 704/230 |
| 7,379,866 | B2 * | 5/2008 | Gao | 704/220 |
| 7,383,176 | B2 * | 6/2008 | Yasunaga et al. | 704/219 |
| 8,032,363 | B2 * | 10/2011 | Chen et al. | 704/225 |
| 8,239,191 | B2 * | 8/2012 | Ehara et al. | 704/219 |

FOREIGN PATENT DOCUMENTS

| | | | |
|---|---|---|---|
| CN | 1327574 | A | 12/2001 |
| CN | 1483189 | A | 3/2004 |
| CN | 101087319 | A | 12/2007 |
| JP | 9046233 | A | 2/1997 |
| JP | 2002-196799 | A | 7/2002 |
| JP | 2004077961 | A | 3/2004 |
| JP | 2004512562 | A | 4/2004 |
| JP | 2009545788 | A | 12/2009 |
| JP | 2010518453 | A | 5/2010 |

(Continued)

OTHER PUBLICATIONS

Written Opinion of the International Searching Authority in corresponding PCT Application No. PCT/CN2009/070840 (Jun. 4, 2009).

(Continued)

*Primary Examiner* — Jesse Pullias
(74) *Attorney, Agent, or Firm* — Leydig, Voit & Mayer, Ltd.

(57) ABSTRACT

A method for generating background noise and a noise processing apparatus are provided in order to improve user experience. The method includes: if an obtained signal frame is a noise frame, a high band noise encoding parameter is obtained from the noise frame; weighting and/or smoothing is performed on the high band noise encoding parameter to obtain a second high band noise encoding parameter; and a high band background noise signal is generated according to the second high band noise encoding parameter. A noise processing apparatus is also provided.

15 Claims, 4 Drawing Sheets

FOREIGN PATENT DOCUMENTS

| | | | |
|---|---|---|---|
| JP | 2010520513 | A | 6/2010 |
| JP | 2011512563 | A | 4/2011 |
| WO | WO 2006008932 | A1 | 1/2006 |
| WO | WO 2007/140724 | | 12/2007 |

OTHER PUBLICATIONS

International Search Report in corresponding PCT Application No. PCT/CN2009/070840 (Jun. 4, 2009).

1st Office Action in corresponding European Application No. 09721909.1 (Oct. 28, 2011).

Extended European Search Report in corresponding European Application No. 09721909.1 (Mar. 3, 2011).

McCree et al., "An Embedded Adaptive Multi-Rate Wideband Speech Coder," DSP Solutions R&D Center, 2001, Institute of Electrical and Electronics Engineers, Dallas, Texas.

Geiser et al., "Bandwidth Extension for Hierarchical Speech and Audio Coding in ITU-T Rec. G.729.1," IEEE Transactions on Audio, Speech, and Language Processing, Nov. 2007, vol. 15, No. 8, Institute of Electrical and Electronics Engineers, New York, New York.

Notice to Submit a Response in corresponding Korean Application No. 20107023132 (Jan. 18, 2012).

1st Office Action in corresponding Chinese Application No. 200810085177.0 (Jan. 8, 2010).

2nd Office Action in corresponding Chinese Application No. 200810085177.0 (Apr. 23, 2010).

"3GPP TS 26.092—Technical Specification Group Services and System Aspects; Mandatory speech codec speech processing functions; Adaptive Multi-Rate (AMR) speech codec; Comfort noise aspects (Release 6)," Dec. 2004, Version 6.0.0, 3rd Generation Partnership Project, Valbonne, France.

"3GPP TS 26.192—Technical Specification Group Services and System Aspects; Speech codec speech processing functions; Adaptive Multi-Rate—Wideband (AMR-WB) speech codec; Comfort noise aspects (Release 6)," Dec. 2004, Version 6.0.0, 3rd Generation Partnership Project, Valbonne, France.

"G.729—Coding of Speech at 8 kbit/s Using Conjugate-Structure Algebraic-Code-Excited Linear-Prediction (CS-ACELP)," General Aspects of Digital Transmission Systems, Mar. 1996, International Telecommunication Union, Geneva, Switzerland.

"G.729 Annex B—Coding of Speech at 8 kbit/s Using Conjugate-Structure Algebraic-Code-Excited Linear-Prediction (CS-ACELP), Annex B: A silence compression scheme for G.729 optimized for terminals conforming to Recommendation V.70," Series G: Transmission Systems and Media, Nov. 1996, International Telecommunication Union, Geneva, Switzerland.

"G.729.1—G.729 based Embedded Variable bit-rate coder: An 8-32 kbit/s scalable wideband coder bitstream interoperable with G.729," Series G: Transmission Systems and Media, Digital Systems and Networks, May 2006, International Telecommunication Union, Geneva, Switzerland.

Notice of Allowance in corresponding Korean Patent Application No. 102010-7023132 (Feb. 18, 2013).

* cited by examiner

METHOD FOR GENERATING BACKGROUND NOISE AND NOISE PROCESSING APPARATUS

CROSS REFERENCE TO RELATED APPLICATIONS

This application is a continuation of International Application No PCT/CN2009/070840, filed on Mar. 17 2009, which claims priority to Chinese Patent Application No. 200810085177.0, filed on Mar. 20, 2008, both of which are hereby incorporated by reference in their entireties.

FIELD OF THE INVENTION

The present invention relates to communication, and more particularly, to a method for generating background noise and a noise processing apparatus.

BACKGROUND

In current data transmission systems, the transmission bandwidth of a speech signal can be compressed with a speech coding technique to increase the capacity of the communication system. Since only about 40% of the content of speech communications include speech, and the other transmission contents are only silence or background noise, a Discontinuous Transmission System (DTX)/Comfortable Noise Generation (CNG) technique has emerged in order to further save the transmission bandwidth.

A method for generating noise based on DTX/CNG in conventional systems includes the following steps:

At an encoding end, an input background noise signal is filtered into two subbands to output a low subband signal and a high subband signal.

The two subband signals are encoded to obtain a narrow band encoding parameter and a high band encoding parameter. The encoding parameters of the two subbands are combined into a non-noise frame. If the current decision of the DTX is "transmit," the high band encoding parameter and the a narrow band encoding parameter are assembled into a Silence Insertion Descriptor (SID) frame, and then the SID frame is transmitted to a decoding end; otherwise, a NODATA frame without any data is transmitted to the decoding end.

At the decoding end, if the received encoded bitstream includes only an encoding parameter of narrow band, decoding is performed by a decoding way of 729B, where the encoding parameter is used for a first 10 ms frame, and a second 10 ms frame is processed as a NODATA frame.

If there is an encoding parameter of wide band in the received encoded bitstream, where the wide band includes a high band and a narrow band, the decoding process includes the following steps:

If the received frame is a SID frame, a narrow band encoding parameter and a high band encoding parameter are obtained by decoding the SID frame, and a narrow band background noise and a high band background noise are generated according to the narrow band encoding parameter and the high band encoding parameter.

If the received frame is a NODATA frame, a narrow band encoding parameter is obtained by an encoding way of 729B, and a narrow band background noise is obtained by a CNG way of 729B. A high band encoding parameter is the same as the high band encoding parameter of the previous SID frame: $P_{WB}=P_{WB_PRE_SID}$, and a high band background noise is generated accordingly.

However, in the above technical solution, since the high band encoding parameter of the previous SID frame is directly copied as the high band encoding parameter of the current frame when a NODATA frame is received, the encoding effects of the two SID frames are completely identical. If the encoding parameters of two adjacent SID frames are quite different, the difference between the wide band background noises may be great and a "block" effect in the speech spectrum will be caused, resulting in a breath-like auditory effect on the user, so that user experience is degraded.

SUMMARY

Embodiments of the present invention provide a method for generating background noise and a noise processing apparatus, in order to improve user experience.

A method for generating background noise according to an embodiment of the present invention includes: if an obtained signal frame is a noise frame, obtaining a high band noise encoding parameter from the noise frame; performing weighting and/or smoothing on the high band noise encoding parameter to obtain a second high band noise encoding parameter; and generating a high band background noise signal according to the second high band noise encoding parameter.

A noise processing apparatus according to an embodiment of the present invention includes: a signal frame obtaining unit configured to obtain a signal frame; a parameter obtaining unit configured to obtain a high band encoding parameter from the signal frame, where the high band encoding parameter is a high band noise encoding parameter when the signal frame is a noise frame; a parameter processing unit configured to perform weighting and/or smoothing on the high band noise encoding parameter to obtain a second high band noise encoding parameter when the obtained signal frame is the noise frame; and a noise generating unit configured to generate a high band background noise signal according to the second high band noise encoding parameter.

In embodiments of the present invention, after a signal frame is obtained, if the signal frame is a noise frame, a high band noise encoding parameter is obtained from the noise frame and is processed with weighting and/or smoothing according to the noise frame. After smoothing is performed on the high band noise encoding parameter and/or weighting is performed on the frequency envelope, the continuity of the recovered background noise is increased, so that the difference between SID frames is relatively small, this effectively eliminates the "block" effect, thereby improving user experience.

DETAILED DESCRIPTION

Embodiments of the present invention provide a method for generating background noise and a noise processing apparatus in order to improve user experience.

In the embodiments of the present invention, after a signal frame is obtained, if the signal frame is a noise frame, a high band noise encoding parameter is obtained from the noise frame, and is processed with weighting and/or smoothing according to the noise frame. That is, after smoothing is performed on the high band noise encoding parameter and/or weighting is performed on the frequency envelope, the continuity of the recovered background noise is increased, so that the difference between SID frames is relatively small, this effectively eliminates the "block" effect, thereby improving user experience.

Figure 1:
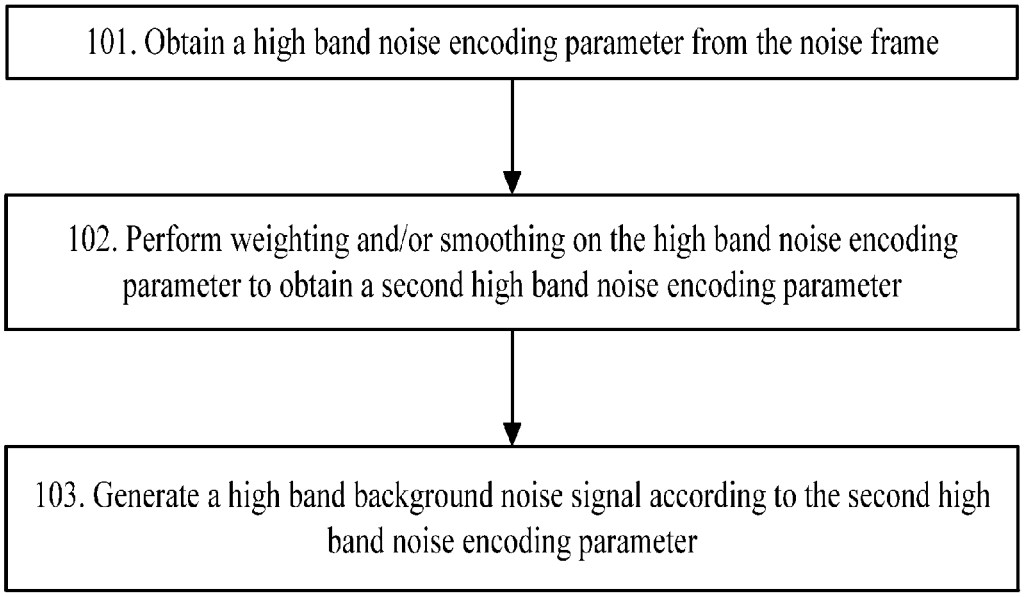
FIG. 1 is a block diagram of a method for generating background noise according to a first embodiment of the present invention.

Referring to FIG. 1, a method for generating background noise according to a first embodiment of the present invention includes steps 101-103.

101: If an obtained signal frame is a noise frame, a high band noise encoding parameter is obtained from the noise frame. In the embodiment, the high band noise encoding parameter includes a time (time-domain) envelope parameter and a frequency (frequency-domain) envelope parameter. The signal frame may be obtained at the encoding end or at the decoding end. The details will be introduced in the following embodiments and is not further described here.

102: Weighting and/or smoothing are performed on the high band noise encoding parameter to obtain a second high band noise encoding parameter. After the noise frame is obtained, weighting and/or smoothing are performed on the high band noise encoding parameter of the noise frame to obtain the second high band noise encoding parameter. It should be noted, in practical applications, a narrow band noise encoding parameter in addition to the high band noise encoding parameter is also included in the noise frame. The detailed process will be illustrated in the following embodiments.

In the embodiment, smoothing may be performed on the high band noise encoding parameter, or weighting may be performed on the high band noise encoding parameter, or both weighting and smoothing may be performed on the high band noise encoding parameter, where better effect may be achieved by both weighting and smoothing.

It should be noted, in the embodiment, in addition to performing weighting and/or smoothing on the high band noise encoding parameter of the noise frame, smoothing may also be performed on the second high band noise encoding parameter according to a high band speech encoding parameter of a speech frame. The detailed process will be described in the following embodiments.

103: A high band background noise signal is generated according to the smoothed and/or weighted high band noise encoding parameter. If the weighting and/or smoothing are performed at the encoding end, the second high band noise encoding parameter and a preset narrow band noise encoding parameter are transmitted to the decoding end, and the background noise signal is generated according to the high band noise encoding parameter and the narrow band noise encoding parameter at the decoding end.

If the weighting and/or smoothing are performed at the decoding end, the signal frame is received at the decoding end from the encoding end, the second high band noise encoding parameter is obtained by performing the weighting and/or smoothing on the high band noise encoding parameter of the signal frame, and the high band background noise signal and the narrow band background noise signal are generated according to the second high band noise encoding parameter and a preset narrow band noise encoding parameter.

For ease of understanding, hereinafter, the detailed description will be provided in terms of different noise processing ends.

Figure 2:
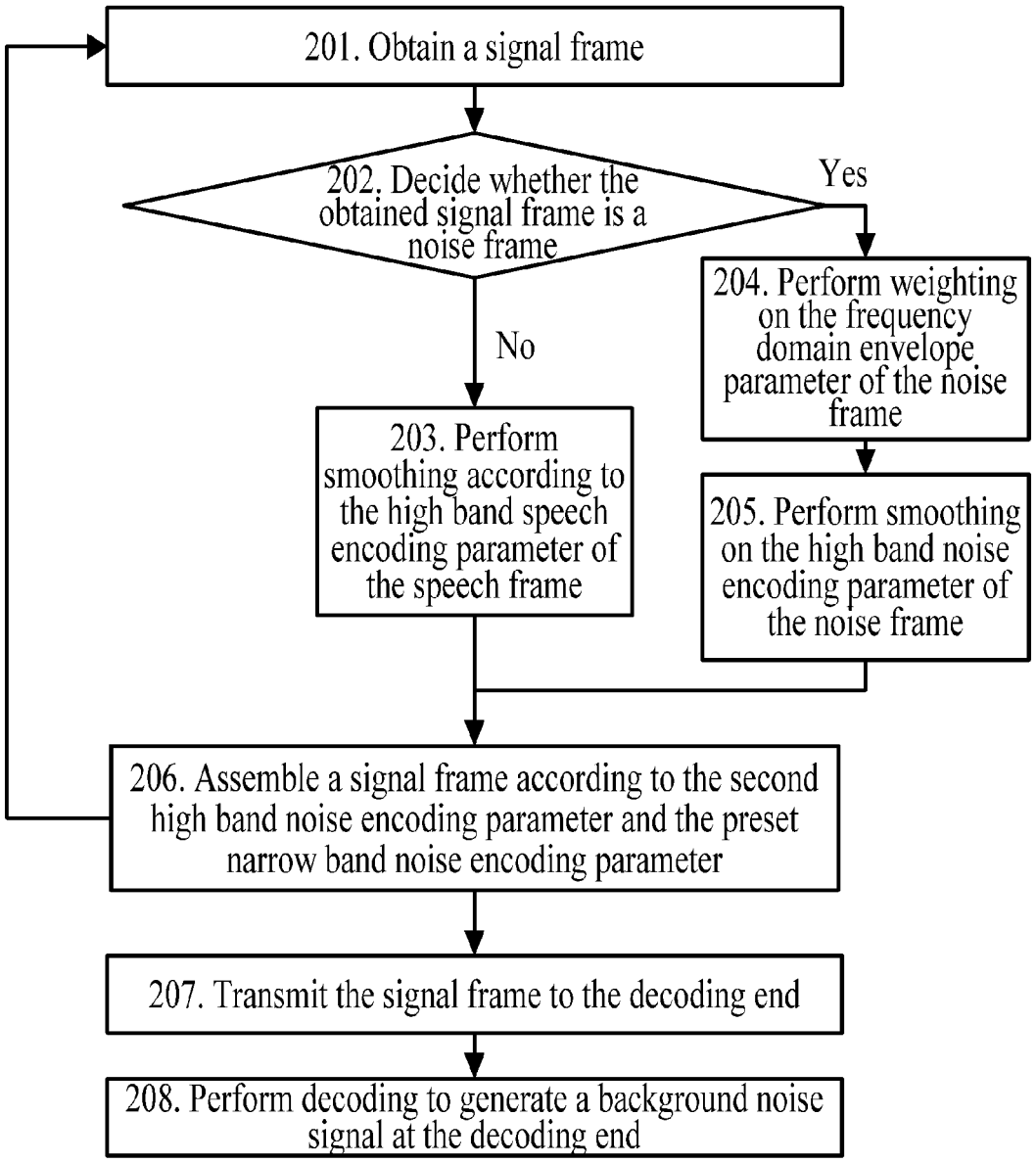
FIG. 2 is a block diagram of a method for generating background noise according to a second embodiment of the present invention.

Referring to FIG. 2, in the method shown in FIG. 2 the noise processing is performed at the encoding end. The method for generating background noise according to the second embodiment of the present invention includes steps 201-208.

201: A signal frame is obtained. In the embodiment, since the noise processing is performed at the encoding end, the signal frame is obtained at the encoding end. For each signal frame, an input background noise signal $S_{WB}(n)$ at the encoding end is filtered by a Quadrature Mirror Filterbank (QMF) ($H_1(z)$, $H_2(z)$) into two subbands, and a low subband signal $S_{LB}(n)$ and a high subband signal $S_{HB}(n)$ are output.

First, the low subband signal $S_{LB}(n)$ is encoded by an encoding way similar to 729B. In order to coordinate with the frame length of 729.1, if the decision of the DTX is "transmit," the first 10 ms frame of the current super-frame is encoded, and a narrow band noise encoding parameter $P_{NB_SID}=[\Omega, E]$ is obtained, where n is the frequency spectrum parameter, E is the excitation energy parameter.

Second, the high subband signal $S_{HB}(n)$ is encoded with a Time-Domain BandWidth Extension (TDBWE) encoder according to the decision of the DTX. A high band noise encoding parameter is obtained, that is, $P_{WB_SID}=\lfloor T_{env_SID}(i), F_{evn_SID}(J)\rfloor$, wherein, $T_{env_SID}(i)$, i=0, . . . , 15 is the time envelope parameter, $F_{env_SID}(j)$, j=0, . . . , 11 is the frequency envelope parameter.

202: It is decided whether the obtained signal frame is a noise frame. If the obtained signal frame is a noise frame, step 204 is performed. If it is not a noise frame, step 203 is performed.

203: Smoothing is performed according to the high band speech encoding parameter of the speech frame, and then step 206 is performed. If the signal frame obtained at the encoding end is a speech frame, smoothing is performed on the second high band noise encoding parameter according to the high band speech encoding parameter of the speech frame. The detailed process is as follows.

Long-term smoothing is performed on the second high band noise encoding parameter $P_{WB_LONG_}$SID by using the high band speech encoding parameters $P_{WB_SPEECH}=T_{env_SPEECH}$ Ii), $F_{env_SPEECH}(j)\rfloor$ of the speech frame, where $T_{env_SID}(i)$, i=0, . . . , 15 is the time envelope parameter, $F_{env_SID}(j)$, j=0, . . . , 11 is the frequency envelope parameter:

$$P_{WB_LONG_SID}=\beta P_{WB_LONG_SID}+(1-\beta)P_{WB_SPEECH}$$

β is a second smoothing parameter, whose value may be 0.5, or may be determined as practically needed. It should be noted, the above smoothing is performed for each time envelope parameter and each frequency envelope parameter, that is:

$$T_{env_LONG_SID}(i)=\beta T_{env_LONG_SID}(i)+(1-\beta)T_{env_SPEECH}(i)$$

$$F_{env_LONG_SID}(j)=\beta F_{env_LONG_SID}(j)+(1-\beta)F_{env_SPEECH}(j)$$

204: Weighting is performed on the frequency envelope parameter of the noise frame. If the signal frame obtained at the encoding end is a noise frame, weighting is performed on the high band noise encoding parameter of the noise frame, that is, weighting is performed on the frequency envelope parameter of the high band noise encoding parameter. The detailed process is as follows.

$$F_{env_SID}(j)=F_{env_SID}(j)*\text{SmoothWindow}(j)$$

The weighting parameter is SmoothWindow(j)=0.8+0.2*cos (jπ/12). The j represents frequency value, and the j is an integral value from 0 to 11. The larger the j, the larger the frequency value, and the aim of the weighting is to attenuate frequency components of high frequency part. It should be noted, the above weighting parameter is just an example, and may be modified according to practical situations, but the weighting parameter needs to be inversely proportional to the frequency value.

It should be noted, the above values of i and j are just examples. In practical applications, the values of i and j may be changed, and are not limited to any specific values.

205: Smoothing is performed on the high band noise encoding parameter of the noise frame. After weighting is performed on the frequency envelope parameter of the high band noise encoding parameter in step 204, smoothing may be performed on the frequency envelope parameter and the time envelope parameter of the high band noise encoding parameter to finally obtain a second high band noise encoding parameter in step 205. The detailed process is as follows.

$$P_{WB_LONG_SID}=\alpha P_{WB_LONG_SID}+(1-\alpha)P_{WB_SID}$$

$$P_{WB_SID}=P_{WB_LONG_SID}$$

$P_{WB_LONG_SID}$ is the second high band noise encoding parameter, $\alpha$ is a first smoothing parameter, whose value is 0.75. The value of the first smoothing parameter may be adjusted according to practical situations, but the value of the first smoothing parameter should be larger than the value of the second smoothing parameter. It should be noted, the above smoothing is performed for each time envelope and each frequency envelope, that is:

$$T_{env_LONG_SID}(i)=\alpha T_{env_LONG_SID}(i)+(1-\alpha)T_{env_SID}(i)$$

$$F_{env_LONG_SID}(j)=\alpha F_{env_LONG_SID}(j)+(1-\alpha)F_{env_SID}(j)$$

$$T_{env_SID}(i)=T_{env_LONG_SID}(i)$$

$$F_{env_SID}(j)=F_{env_LONG_SID}(j)$$

206: A signal frame is assembled according to the second high band noise encoding parameter and a preset narrow band noise encoding parameter, and step 201 is repeatedly performed. After the second high band noise encoding parameter is obtained, a non-noise frame is assembled according to the second high band noise encoding parameter and the narrow band noise encoding parameter.

207: The signal frame is transmitted to the decoding end. If the current decision of the DTX is "transmit," a SID frame is assembled according to the second high band noise encoding parameter and the narrow band noise encoding parameter and is transmitted to the decoding end; otherwise, a NODATA frame without any data is transmitted to the decoding end.

208: A background noise signal is generated by performing decoding at the decoding end. After the signal frame is received at the decoding end from the encoding end, the signal frame is decoded. The process differs for encoded bitstreams containing only a narrow band encoding parameter and those containing a wide band encoding parameter.

If there is only an encoding parameter of narrow band in the received encoded bitstream, the decoding is performed by a decoding way similar to 729B, where the encoding parameter is used for a first 10 ms frame, and a second 10 ms frame is processed as a NODATA frame.

If there is a wide band encoding parameter in the received encoded bitstream, the decoding process is as follows.

If the received frame is a SID frame, the narrow band noise encoding parameter $P_{NB_SID}=[\Omega, E]$ and the second high band noise encoding parameter $P_{WB_SID}=[T_{env_SID}(i), F_{_SID}(j)]$ are obtained through decoding. The narrow band background noise $S_{LB}(n)$ is obtained from the narrow band noise encoding parameter by using a CNG way similar to 729B, and the high band background noise $S_{HB}(n)$ is obtained from the second high band noise encoding parameter by using a TDBWE decoding way of 729.1.

If the received frame is a NODATA frame, the narrow band noise encoding parameter is obtained by using the decoding way similar to 729B, and then the narrow band background noise $S_{LB}(n)$ is obtained by using a CNG way similar to 729B. The high band noise encoding parameter of the previous SID frame is used as the high band noise encoding parameter of the current frame:

$$P_{WB}=P_{WB_PRE_SID}$$

The high subband background noise $S_{HB}(n)$ is obtained from the high band noise encoding parameter by using a TDBWE decoding way of 729.1.

The obtained high subband and low subband signals $S_{HB}(n)$ and $S_{LB}(n)$ are combined by a QMF used in 729.1 to obtain the final wide band background noise signal. Thus, by such CNG operation at the decoding end, the final wide band background noise signal is obtained.

In the above processes, step 203 is an optional step, that is, weighting and/or smoothing may be performed only on the high band noise encoding parameter of the noise frame. The information of the speech frame may also be included in the $P_{WB_LONG_SID}$ by performing step 203, so that the recovered signal may become more smooth and continuous.

Furthermore, there is no fixed performing sequence between step 204 and step 205, that is, step 204 may be performed before step 205, or step 205 may be performed before step 204, this is not limited.

In the above embodiment, after smoothing is performed on the high band noise encoding parameter and/or weighting is performed on the frequency envelope for the noise frame at the encoding end, the second high band noise encoding parameter is obtained. In this way the continuity of the recovered background noise is improved, so that the difference between SID frames is relatively small. Thus, the "block" effect is eliminated effectively and user experience can be improved.

Since smoothing may be performed on the second high band noise encoding parameter according to the high band speech encoding parameter of the speech frame, the information of the speech frame may be included in the second high band noise encoding parameter $P_{WB_LONG_SID}$, this make the recovered signal more smooth and continuous.

Figure 3:
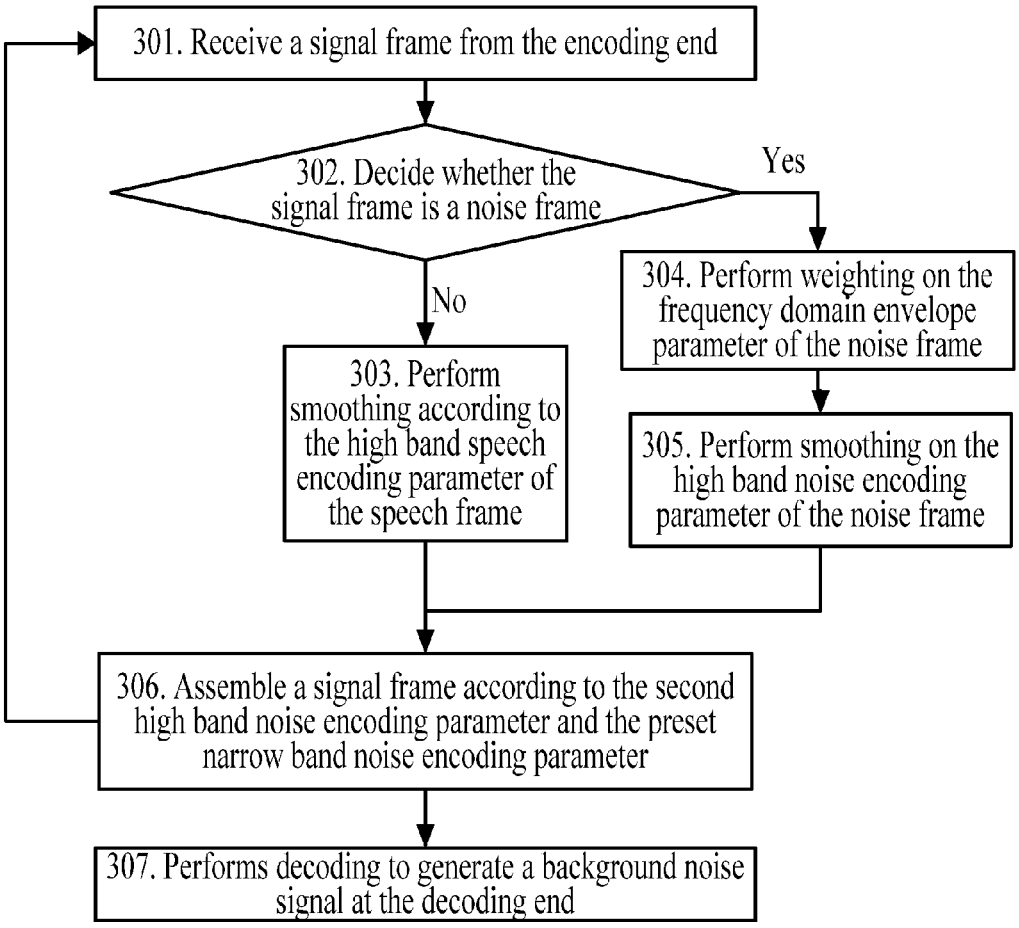
FIG. 3 is a block diagram of a method for generating background noise according to a third embodiment of the present invention.

The case in which the high band noise encoding parameter is processed at the encoding end is introduced above. The case in which the high band noise encoding parameter is processed at the decoding end will be introduced hereafter. Referring to FIG. 3, a method for generating background noise according to a third embodiment of the present invention includes steps 301-307.

301: A signal frame is received from an encoding end. The signal frame is received at the decoding end from the encoding end. The generating process of the signal frame includes the following steps.

First, an input background noise signal $S_{WB}(n)$ is filtered into two subbands by a QMF($H_1(z)$, $H_2(z)$) at the encoding end, and a low subband signal $S_{LB}(n)$ and a high subband signal $S_{HB}(n)$ are output.

Second, the low subband signal $S_{LB}(n)$ is encoded by using an encoding way similar to 729B. In order to coordinate with the frame length of 729.1, if the decision of the DTX is "transmit," the first 10 ms frame of the current super-frame is encoded, and a narrow band noise encoding parameter $P_{NB_SID}=[\Omega, E]$ is obtained, where $\Omega$ is the frequency spectrum parameter, E is the excitation energy parameter.

Third, the high subband signal $S_{HB}(n)$ is encoded with a TDBWE encoder according to the decision of DTX. A high band noise encoding parameter is obtained, that is, $P_{WB_SID}=\lfloor T_{env_SID}(i), F_{env_SID}(j)\rfloor$, where $T_{env_SID}(i)$, i=0, . . . , 15 is the time envelope parameter, $F_{env_SID}(j)$, j=0, . . . , 11 is the frequency envelope parameter. The larger the j, the higher the corresponding frequency.

Finally, the encoding parameters of the two subbands are combined into a non-noise frame. If the current decision of the DTX is "transmit," the high band noise encoding parameter and the narrow band noise encoding parameter are assembled into a SID frame, and the SID frame is transmitted to the decoding end, otherwise, a NODATA frame without any data is transmitted to the decoding end.

302: It is decided whether the obtained signal frame is a noise frame. If it is a noise frame, step 304 is performed. If it is not a noise frame, step 303 is performed.

303: Smoothing is performed according to the high band speech encoding parameter of the speech frame, and then step 306 is performed. If the signal frame obtained at the encoding end is a speech frame, smoothing is performed on a second high band noise encoding parameter according to the high band speech encoding parameter of the speech frame. The detailed process is as follows.

Long-term smoothing is performed on the second high band noise encoding parameter $P_{WB_LONGSID}$ by using the high band speech encoding parameter $P_{WB_SPEECH}=\lfloor T_{env_SPEECH}(i), F_{env_SPEECH}(j)\rfloor$ of the speech frame, where $T_{env_SPEECH}(i)$, i=0, . . . , 15 is the time envelope parameter, $F_{env_SPEECH}(j)$, j=0, . . . , 11 is the frequency envelope parameter.

$$P_{WB_LONG_SID}=\beta P_{WB_LONG_SID}+(1-\beta)P_{WB_SPEECH}$$

$\beta$ is the second smoothing parameter, whose value may be 0.5, or may be determined as practically needed. It should be noted, the above smoothing is performed for each time envelope parameter and each frequency envelope parameter, that is:

$$T_{env_LONG_SID}(i)=\beta T_{env_LONG_SID}(i)+(1-\beta)T_{env_SPEECH}(i)$$

$$F_{env_LONG_SID}(j)=\beta F_{env_LONG_SID}(j)+(1-\beta)F_{env_SPEECH}(i)$$

304: Weighting is performed on the frequency envelope parameter of the noise frame. If the signal frame obtained at the decoding end is a noise frame, weighting is performed on the high band noise encoding parameter of the noise frame, that is, weighting is performed on the frequency envelope parameter of the high band noise encoding parameter. The detailed process is as follows.

$$F_{env_SID}(j)=F_{env_SID}(j)*\mathrm{SmoothWindow}(j)$$

The weighting parameter is SmoothWindow(j)=0.8+0.2* cos ($j\pi/12$). The above j represents frequency value, and may be an integral value from 0 to 11. The larger the j, the larger the frequency value. The aim of weighting is to attenuate the frequency components of high frequency portion. It should be noted, the above weighting parameter is just an example, and may be modified according to practical situations, but the weighting parameter needs to be inversely proportional to the frequency value.

It should be noted, the above values of i and j are only examples. In practical applications, the values of i and j may be changed, and the specific values are not limited.

305: Smoothing is performed on the high band noise encoding parameter of the noise frame. After weighting is performed on the frequency envelope parameter of the high band noise encoding parameter in step 304, smoothing is needed to be performed on the frequency envelope parameter and the time envelope parameter of the high band noise encoding parameter to obtain a second high band noise encoding parameter. The detailed process is as follows.

$$P_{WB_LONG_SID}=\alpha P_{WB_LONG_SID}+(1-\alpha)P_{WB_SID}$$

$$P_{WB_SID}=P_{WB_LONG_SID}$$

$\alpha$ is the first smoothing parameter whose value is 0.75. The value of the first smoothing parameter may be adjusted according to practical situations, but the value of the first smoothing parameter should be larger than the value of the second smoothing parameter. It should be noted, the above smoothing is performed for each time envelope and each frequency envelope, that is:

$$T_{env_LONG_SID}(i)=\alpha T_{env_LONG_SID}(i)+(1-\alpha)T_{env_SID}(i)$$

$$F_{env_LONG_SID}(j)=\alpha F_{env_LONG_SID}(j)+(1-\alpha)F_{env_SID}(j)$$

$$T_{env_SID}(i)=T_{env_LONG_SID}(i)$$

$$F_{env_SID}(j)=F_{env_LONG_SID}(j)$$

306: A signal frame is assembled according to the second high band noise encoding parameter and the preset narrow band noise encoding parameter, and step 301 is repeatedly performed.

In the embodiment, the narrow band background noise $S_{LB}(n)$ is obtained from the narrow band noise encoding parameter by using a CNG way similar to 729B, and the high subband background noise $S_{HB}(n)$ is obtained from the second high band noise encoding parameter by using a TDBWE decoding way of 729.1.

If the received frame is a NODATA frame, the narrow band noise encoding parameter is obtained by using a decoding way similar to 729B, and then the narrow band background noise $S_{LB}(n)$ is obtained by using a CNG way similar to 729B. The high band noise encoding parameter of the previous SID frame is used as the high band noise encoding parameter of the current frame:

$$P_{WB}=P_{WB_PRE_SID}$$

Then the high subband background noise $S_{HB}(n)$ is obtained from the high band noise encoding parameter by using a TDBWE decoding way of 729.1

307: A background noise signal is generated by performing decoding at the decoding end. The obtained high subband signal $S_{HB}(n)$ and low subband signal $S_{LB}(n)$ are combined by a QMF used in 729.1 to obtain the final wide band background noise signal. In this way, the final wide band background noise signal is obtained through such CNG operation at the decoding end.

In the above process, step 303 is an optional step, that is, weighting and/or smoothing is performed only on the high band noise encoding parameter of the noise frame to obtain the second high band noise encoding parameter $P_{WB_LONG_SID}$. The information of the speech frame may also be included in the $P_{WB_LONG_SID}$ by performing step 303, so that the recovered signal may become more smooth and continuous.

Furthermore, there is no fixed performing sequence between step 304 and step 305, that is, step 304 may be performed before step 305, or step 305 may be performed before step 304, this is not limited herein.

In the above embodiment, the second high band noise encoding parameter is obtained after smoothing is performed on the high band noise encoding parameter and/or weighting is performed on the frequency envelope for the noise frame at the decoding end. The continuity of the recovered background noise is increased, so that the difference between SID frames is relatively small. This effectively eliminates the "block" effect, thereby improving user experience.

Since smoothing may be performed on the second high band noise encoding parameter according to the high band speech encoding parameter of the speech frame, the information of the speech frame may be included in the second high band noise encoding parameter $P_{WB_LONG_SID}$, this may make the recovered signal more smooth and continuous.

Figure 4:
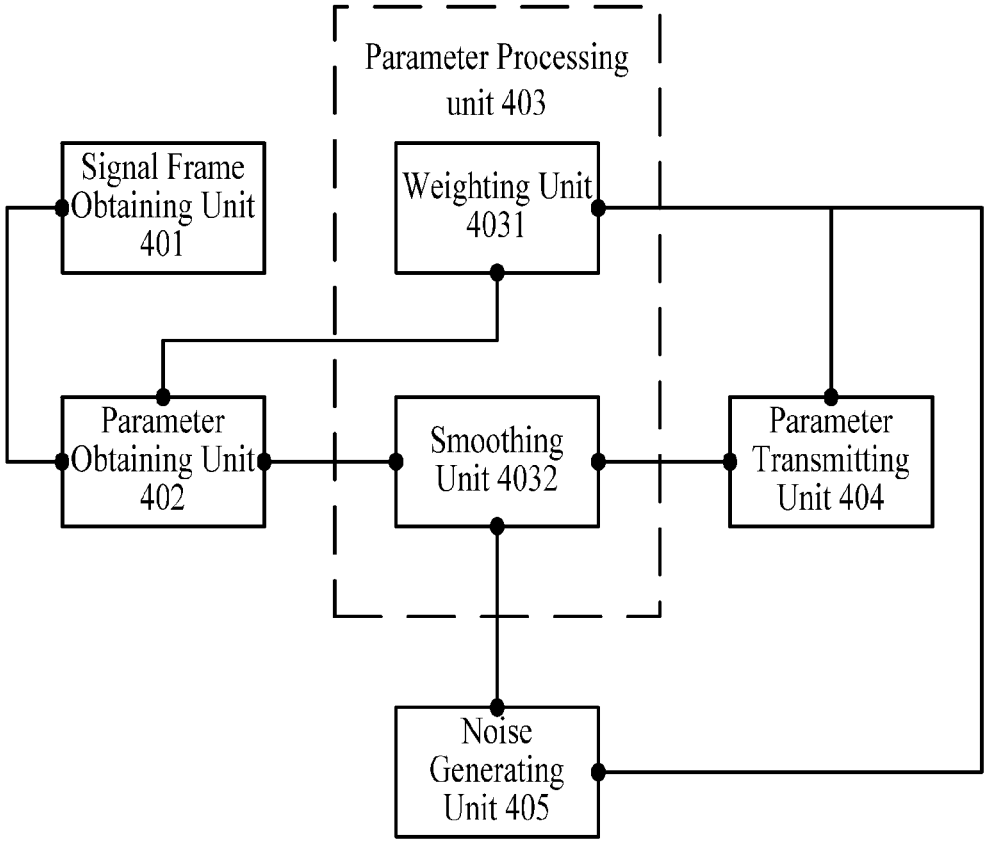
FIG. 4 is a block diagram of a noise processing apparatus according to an embodiment of the present invention.

Referring to FIG. 4, a noise processing apparatus according to an embodiment of the present invention includes:

a signal frame obtaining unit 401, configured to obtain a signal frame;

a parameter obtaining unit 402, configured to obtain a high band noise encoding parameter from the signal frame; and a parameter processing unit 403, configured to perform weighting and/or smoothing on the high band noise encoding parameter to obtain a second high band noise encoding parameter when the obtained signal frame is a noise frame.

In the embodiment, the parameter processing unit 403 is configured to perform smoothing on the second high band noise encoding parameter according to a high band speech encoding parameter of a speech frame when the obtained signal frame is the speech frame.

In the embodiment, the noise processing apparatus may further include: a parameter transmitting unit 404, configured to transmit the second high band noise encoding parameter to the decoding end.

If the noise processing apparatus is at the encoding end, the noise processing apparatus includes the parameter transmitting unit 404.

In the embodiment, the noise processing apparatus may further include:

a noise generating unit 405, configured to generate a high band background noise signal according to the second high band noise encoding parameter.

If the noise processing apparatus is at the decoding end, the noise processing apparatus includes the noise generating unit 405.

In the embodiment, the parameter processing unit 403 includes at least one of the following units:

a weighting unit 4031, configured to multiply a frequency envelope parameter of the high band noise encoding parameter with a preset weighting parameter to obtain a weighted frequency envelope parameter, where the weighting parameter is inversely proportional to the frequency value of the frequency envelope parameter;

a smoothing unit 4032, configured to calculate with a preset first smoothing parameter and the high band noise encoding parameter to obtain the second high band noise encoding parameter:

$$P_{WB_LONG_SID}=\alpha P_{WB_LONG_SID}+(1-\alpha)P_{WB_SID}$$

$$P_{WB_SID}=P_{WB_LONG_SID}$$

In the above formulas, $P_{WB_LONG_SID}$ is the second high band noise encoding parameter, $\alpha$ is the first smoothing parameter, $P_{WB_SID}$ is the current high band noise encoding parameter. The above smoothing is performed for the high band noise encoding parameter of the noise frame, or the smoothing unit 4032 is configured to calculate with the preset second smoothing parameter and the high band speech encoding parameter to obtain the second high band noise encoding parameter:

$$P_{WB_LONG_SID}=\beta P_{WB_LONG_SID}+(1-\beta)P_{WB_SPEECH}$$

In the above formula, $P_{WB_LONG_SID}$ is the second high band noise encoding parameter, $\beta$ is the second smoothing parameter, $P_{WB_SPEECH}$ is the current high band speech encoding parameter, and the second smoothing parameter is smaller than the first smoothing parameter.

The above smoothing is performed for the high band noise encoding parameter with respect to the speech frame.

The detailed process among respective units is similar to the process in the above embodiments of method for generating background noise, and will not be described herein.

In the embodiments of the present invention, after a signal frame is obtained, if the signal frame is a noise frame, a high band noise encoding parameter is obtained from the noise frame, and weighting and/or smoothing are performed on the high band noise encoding parameter according to the noise frame. That is, after smoothing is performed on the high band noise encoding parameter and/or weighting is performed on the frequency envelope, the continuity of the recovered background noise is increased, so that the difference between SID frames is relatively small. This effectively eliminates the "block" effect, thereby user experience can be improved.

Those skilled in the art may understand that all or part of the steps in the above embodiments of method may be implemented by program instructions executed on a related hardware. The program may be stored in computer readable storage media. The program, when executed, includes the following steps:

if an obtained signal frame is a noise frame, a high band noise encoding parameter is obtained from the noise frame;

weighting and/or smoothing are performed on the high band noise encoding parameter to obtain a second high band noise encoding parameter;

a high band background noise signal is generated according to the second high band noise encoding parameter.

The above storage media may be Read Only Memory (ROM), magnetic disk or optical disc, etc.

Detailed description is provided above for a background noise generating method and a noise processing apparatus according to present invention. For those skilled in the art, various modifications may be made on the specific embodiments without departing from the principle of the present invention. Therefore, the content of the description should not be construed as limiting the scope of the present invention.

What is claimed is:

1. A method for generating background noise, comprising:

if an obtained signal frame is a noise frame, obtaining a high band noise encoding parameter from the noise frame;

performing at least one of weighting and smoothing on the high band noise encoding parameter to obtain a second high band noise encoding parameter; and generating a high band background noise signal according to the second high band noise encoding parameter;

wherein the high band background noise encoding parameter includes a time envelope parameter and a frequency envelope parameter, and the performing weighting on the high band noise encoding parameter to obtain the second high band noise encoding parameter comprises:

multiplying the frequency envelope parameter with a preset weighting parameter to obtain a weighted frequency envelope parameter, wherein the weighting parameter is inversely proportional to the frequency value of the frequency envelope parameter; and using a high band noise encoding ammeter including the weighted frequency envelope parameter as the second high band noise encoding parameter; and the performing smoothing on the high band noise encoding parameter to obtain the second high band noise encoding parameter comprises:

calculating with a preset first smoothing parameter and the high band noise encoding parameter to obtain the second high band noise encoding parameter according to a formula:

$$P_{WB_LONG_SID}=\alpha P_{WB_LONG_SID}+(1-\alpha)P_{WB_SID}$$

wherein the $P_{WB_}LONG_{_SID}$ is the second high band noise encoding parameter, $\alpha$ is the first smoothing parameter, and $P_{WB_SID}$ is the current high band noise encoding parameter.

2. The method according to claim 1, wherein if an obtained signal frame is a speech frame, obtaining a high band speech encoding parameter from the speech frame, and performing smoothing on the second high band noise encoding parameter according to the high band speech encoding parameter of the speech frame.

3. The method according to claim 1, wherein the multiplying the frequency envelope parameter with the preset weighting parameter to obtain the weighted frequency envelope parameter further comprises:

calculating with the frequency envelope parameter and the weighting parameter according to formulas of:

$$F_{env_SID}(j)=F_{env_SID}(j)\times \mathrm{SmoothWindow}(j)$$

$$\mathrm{SmoothWindow}(j)=0.8+0.2\times\cos(j\pi/12)$$

wherein $F_{env_SID}(j)$ is the frequency envelope parameter, SmoothWindow(j) is the weighting parameter, the value of j is any integer value from 0 to 11 and is proportional to the frequency value.

4. The method according to claim 1, wherein the performing smoothing on the second high band noise encoding parameter according to the high band speech encoding parameter of the speech frame further comprises:

calculating with a preset second smoothing parameter and the high band speech encoding parameter to obtain the second high band noise encoding parameter according to a formula:

$$P_{WB_LONG_SID}=\beta P_{WB_LONG_SID}+(1-\beta)P_{WB_SPEECH}$$

wherein $P_{WB_LONG_SID}$ is the second high band noise encoding parameter, $\beta$ is the second smoothing parameter, $P_{WB_SPEECH}$ is the current high band noise encoding parameter, the second smoothing parameter is smaller than the first smoothing parameter.

5. The method according to claim 1, wherein the signal frame is obtained at least one of an encoding end and a decoding end, and if the signal frame is obtained at the encoding end, after the performing at least one of weighting and smoothing on the high band noise encoding parameter to obtain the second high band noise encoding parameter, the method further comprises:

transmitting a signal frame including the second high band noise encoding parameter to the decoding end.

6. A noise processing apparatus, comprising:

a signal frame obtaining unit configured to obtain a signal frame;

a parameter obtaining unit configured to obtain a high band encoding parameter from the signal frame, wherein the high band encoding parameter is a high band noise encoding parameter when the signal frame is a noise frame;

a parameter processing unit configured to perform at least one of weighting and smoothing on the high band noise encoding parameter to obtain a second high band noise encoding parameter when the obtained signal frame is the noise frame; and a noise generating unit configured to generate a high band background noise signal according to the second high band noise encoding parameter;

wherein the parameter processing unit further comprises at least one of:

a weighting unit configured to multiply a frequency envelope parameter of the high band noise encoding parameter with a preset weighting parameter to obtain a weighted frequency envelope parameter, wherein the weighting parameter is inversely proportional to the frequency value of the frequency envelope parameter;

a smoothing unit configured to calculate with a preset first smoothing parameter and the high band noise encoding parameter to obtain the second high band noise encoding parameter according to formulas of:

$$P_{WB_LONG_SID}=\alpha P_{WB_LONG_SID}+(1-\alpha)P_{WB_SID}$$

$$P_{WB_SID}=P_{WB_LONG_SID}$$

wherein $P_{WB_LONG_SID}$ is the second high band noise encoding parameter, $\alpha$ is the first smoothing parameter, $P_{WB_SID}$ is the current high band noise encoding parameter;

or the smoothing unit is configured to calculate with a preset second smoothing parameter and the high band speech encoding parameter to obtain the second high band noise encoding parameter according to a formula:

$$P_{WB_LONG_SID}=\beta P_{WB_LONG_SID}+(1-\beta)P_{WB_SPEECH}$$

wherein $P_{WB_LONG_SID}$ is the second high band noise encoding parameter, $\beta$ is the second smoothing parameter, $P_{WB_SPEECH}$ is the current high band speech encoding parameter, and the second smoothing parameter is smaller than the first smoothing parameter.

7. The noise processing apparatus according to claim 6, wherein the high band encoding parameter obtained by the parameter obtaining unit is a high band speech encoding parameter when the signal frame is a speech frame, and the parameter processing unit is further configured to perform smoothing on the second high band noise encoding parameter according to the high band speech encoding parameter of the speech frame when the obtained signal frame is the speech frame.

8. The noise processing apparatus according to claim 6, wherein the noise processing apparatus further comprises:

a parameter transmitting unit configured to transmit the second high band noise encoding parameter to a decoding end.

9. A method for generating background noise, comprising:

if an obtained signal frame is a noise frame, obtaining a high band noise encoding parameter from the noise frame; wherein the high band noise encoding parameter includes a time envelope parameter and a frequency envelope parameter;

performing weighting on the frequency envelope parameter to obtain a weighted frequency envelope parameter according to formulas of:

$$F_{env_SID}(j)=F_{env_SID}(j)\times \mathrm{SmoothWindow}(j)$$

$$\mathrm{SmoothWindow}(j)=0.8+0.2\times\cos(j\pi/12)$$

wherein $F_{env_SID}(j)$ is the frequency envelope parameter, SmoothWindow(j) is the weighting parameter, and j is the frequency value of the frequency envelope parameter;

using a high band noise encoding parameter including the weighted frequency envelope parameter as the current high band noise encoding parameter;

performing smoothing on the current high band noise encoding parameter to obtain a second high band noise encoding parameter; and generating a high band background noise signal according to the second high band noise encoding parameter.

10. The method according to claim 9, wherein the performing smoothing on the current high band noise encoding parameter to obtain a second high band noise encoding parameter comprises:

calculating with a preset first smoothing parameter and the high band noise encoding parameter to obtain the second high band noise encoding parameter according to a formula:

$$P_{WB_LONG_SID}=\alpha P_{WB_LONG_SID}+(1-\alpha)P_{WB_SID}$$

wherein the $P_{WB_LONG_SID}$ is the second high band noise encoding parameter, $\alpha$ is the first smoothing parameter, and $P_{WB_SID}$ is the current high band noise encoding parameter.

11. The method according to claim 10, wherein the value of j is any integer value from 0 to 11.

12. The method according to claim 10, wherein the $\alpha$ equals to 0.75.

13. The method according to claim 9, further comprising:

if the obtained signal frame is a speech frame, obtaining a high band speech encoding parameter from the speech frame, and performing smoothing on the second high band noise encoding parameter according to the high band speech encoding parameter of the speech frame.

14. The method according to claim 13, wherein the performing smoothing on the second high band noise encoding parameter according to the high band speech encoding parameter of the speech frame further comprises:

calculating with a preset second smoothing parameter and the high band speech encoding parameter to obtain the second high band noise encoding parameter according to a formula:

$$P_{WB_LONG_SID}=\beta P_{WB_LONG_SID}+(1-\beta)P_{WB_SPEECH}$$

wherein $P_{WB_LONG_SID}$ is the second high band noise encoding parameter, $\beta$ is the second smoothing parameter, $P_{WB_SPEECH}$ is the second high band noise encoding parameter, the second smoothing parameter is smaller than the first smoothing parameter.

15. The method according to claim 14, wherein the $\beta$ equals to 0.5.

* * * * *

UNITED STATES PATENT AND TRADEMARK OFFICE

CERTIFICATE OF CORRECTION

PATENT NO. : 8,494,846 B2
APPLICATION NO. : 12/886159
DATED : July 23, 2013
INVENTOR(S) : Dai et al.

It is certified that error appears in the above-identified patent and that said Letters Patent is hereby corrected as shown below:

In the Claims

Claim 1, Column 11, Line 9 "using a high band noise encoding ammeter" should read -- using a high band noise encoding parameter --.

Claim 4, Column 11, Line 54 "$P_{WB_LONG_SID} - \beta P_{WB_LONG_SID} + (1-\beta) P_{WB_SPEECH}$" should read -- $P_{WB_LONG_SID} = \beta P_{WB_LONG_SID} + (1-\beta) P_{WB_SPEECH}$ --.

Signed and Sealed this
Fifteenth Day of October, 2013

Teresa Stanek Rea

Teresa Stanek Rea
*Deputy Director of the United States Patent and Trademark Office*